US012788174B2

(12) United States Patent
Harris

(10) Patent No.: US 12,788,174 B2
(45) Date of Patent: Nov. 10, 2026

(54) WINDOW DRAPE ACCESSORY DEVICE

(71) Applicant: Desera Harris, Muskogee, OK (US)

(72) Inventor: Desera Harris, Muskogee, OK (US)

( * ) Notice: Subject to any disclaimer, the term of this patent is extended or adjusted under 35 U.S.C. 154(b) by 156 days.

(21) Appl. No.: 18/794,763

(22) Filed: Aug. 5, 2024

(65) Prior Publication Data

US 2026/0033658 A1 Feb. 5, 2026

(51) Int. Cl.
*A47H 23/02* (2006.01)

(52) U.S. Cl.
CPC ..... *A47H 23/02* (2013.01)

(58) Field of Classification Search
CPC ..... A47H 23/02; A47H 23/04; A47H 23/06; A47H 13/14; A47H 13/16; A47H 13/02; A47H 2201/02; A47H 2023/003; A47H 13/00; A47H 2201/00
USPC ..... 160/330, 348
See application file for complete search history.

(56) References Cited

U.S. PATENT DOCUMENTS 2,594,624 A * 4/1952 Dubinsky ..... A47H 23/02 160/124
2,609,043 A * 9/1952 Dubinsky ..... A47H 23/04 160/390
4,119,134 A * 10/1978 Morken ..... A47H 13/16 428/181
4,221,255 A 9/1980 Barkemeyer
4,631,765 A * 12/1986 Casey ..... A47G 9/0207 428/33
4,911,220 A * 3/1990 Hiller ..... E06B 9/386 160/236
6,334,477 B1 * 1/2002 Moir ..... E06B 9/264 160/168.1 V
6,789,596 B1 * 9/2004 Lin ..... E06B 9/264 160/168.1 V
7,165,594 B2 * 1/2007 Senesac ..... E06B 9/262 160/178.1 V
9,016,349 B2 4/2015 Seitz
9,113,739 B2 8/2015 Thomas
D745,292 S 12/2015 Thomas
12,404,718 B2 * 9/2025 Schulman ..... E06B 9/367
2003/0051823 A1 * 3/2003 Nien ..... A47H 23/06 160/168.1 R
2004/0221973 A1 * 11/2004 Hesse ..... A47H 21/00 160/368.1

(Continued)

FOREIGN PATENT DOCUMENTS

WO WO20087011461 1/2008

*Primary Examiner* — Abe Massad

(57) ABSTRACT

A window drape accessory device includes a drape panel that has a pair of curtain rod holes each extending through the drape panel to insertably receive a curtain rod thereby enabling the drape panel to be suspended in front of a window. The drape panel has a width is no greater than 53.0 cm to ornamentally accessorize existing drapes on the window without having the drape panel covering the window. A pair of first fasteners is each of the pair of first fasteners is attached to the drape panel and a pair of second fasteners is each of the pair of second fasteners is attached to the drape panel. Each of the pair of second fasteners is releasably matable to a respective one of the pair of first fasteners thereby enabling the drape panel to form a tube to enhance the ornamental appearance of the existing drapes on the window.

6 Claims, 8 Drawing Sheets

(56) References Cited

U.S. PATENT DOCUMENTS

| | | | | |
|---|---|---|---|---|
| 2009/0032199 | A1* | 2/2009 | Woods | E06B 9/36 160/34 |
| 2009/0044888 | A1* | 2/2009 | Ganey | A47H 21/00 160/349.2 |
| 2009/0139664 | A1* | 6/2009 | Graichen | D04B 21/20 160/230 |
| 2010/0051210 | A1 | 3/2010 | Daly | |
| 2010/0186904 | A1* | 7/2010 | Merritt | E06B 9/386 112/475.08 |
| 2011/0168340 | A1 | 7/2011 | Squillante | |
| 2016/0298386 | A1* | 10/2016 | Avinger | E06B 9/36 |
| 2017/0143150 | A1* | 5/2017 | Dubois | A47H 13/14 |
| 2022/0007872 | A1 | 1/2022 | Stern | |

* cited by examiner

WINDOW DRAPE ACCESSORY DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to window drape devices and more particularly pertains to a new window drape device for enhancing the ornamental appearance of existing drapes on a window. The device includes a drape panel that has a width that is substantially less than the width of the existing drapes and a pair of curtain rod holes each extending through the drape panel for insertably receiving a curtain rod. The device includes a pair of first fasteners each attached to the drape panel and a pair of second fasteners each attached to the drape panel on an opposing side of the drape panel with respect to the first fasteners. The first fasteners are matable to the second fasteners to form the drape panel into a tube for further enhancing the ornamental appearance of the existing drapes.

(2) Description of Related Art Including Information Disclosed Under 37 CFR 1.97 and 1.98

The prior art relates to window drape devices including a variety of window treatment panel devices that each at least includes a window treatment panel which has various means of attachment, including hook and loop fasteners and a valence board and loops and magnets for securing the window treatment panel to a curtain rod. In no instance does the prior art disclose a drape panel device that includes a drape panel that has a width which is substantially less than existing drapes on a window and a pair of curtain rod holes extending through the drape panel for insertably receiving a curtain rod and a pair of first fasteners and a pair of second fasteners each attached to the drape panel which are matable together to form the drape panel into a tube.

BRIEF SUMMARY OF THE INVENTION

An embodiment of the disclosure meets the needs presented above by generally comprising a drape panel that has a pair of curtain rod holes each extending through the drape panel to insertably receive a curtain rod thereby enabling the drape panel to be suspended in front of a window. The drape panel has a width is no greater than 53.0 cm to ornamentally accessorize existing drapes on the window without having the drape panel covering the window. A pair of first fasteners is each of the pair of first fasteners is attached to the drape panel and a pair of second fasteners is each of the pair of second fasteners is attached to the drape panel. Each of the pair of second fasteners is releasably matable to a respective one of the pair of first fasteners thereby enabling the drape panel to form a tube to enhance the ornamental appearance of the existing drapes on the window.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
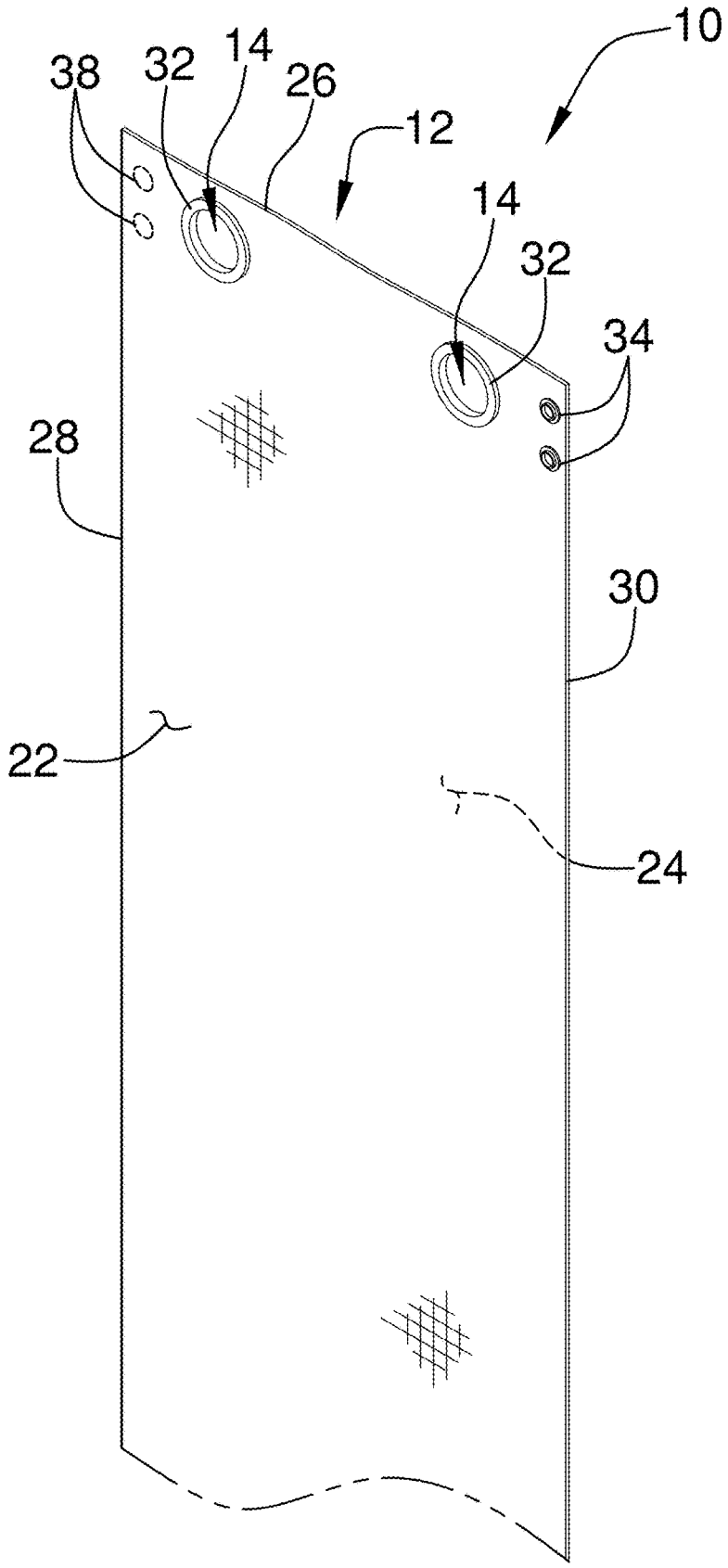
FIG. 1 is a front perspective view of a window drape accessory device according to an embodiment of the disclosure.
Figure 2:
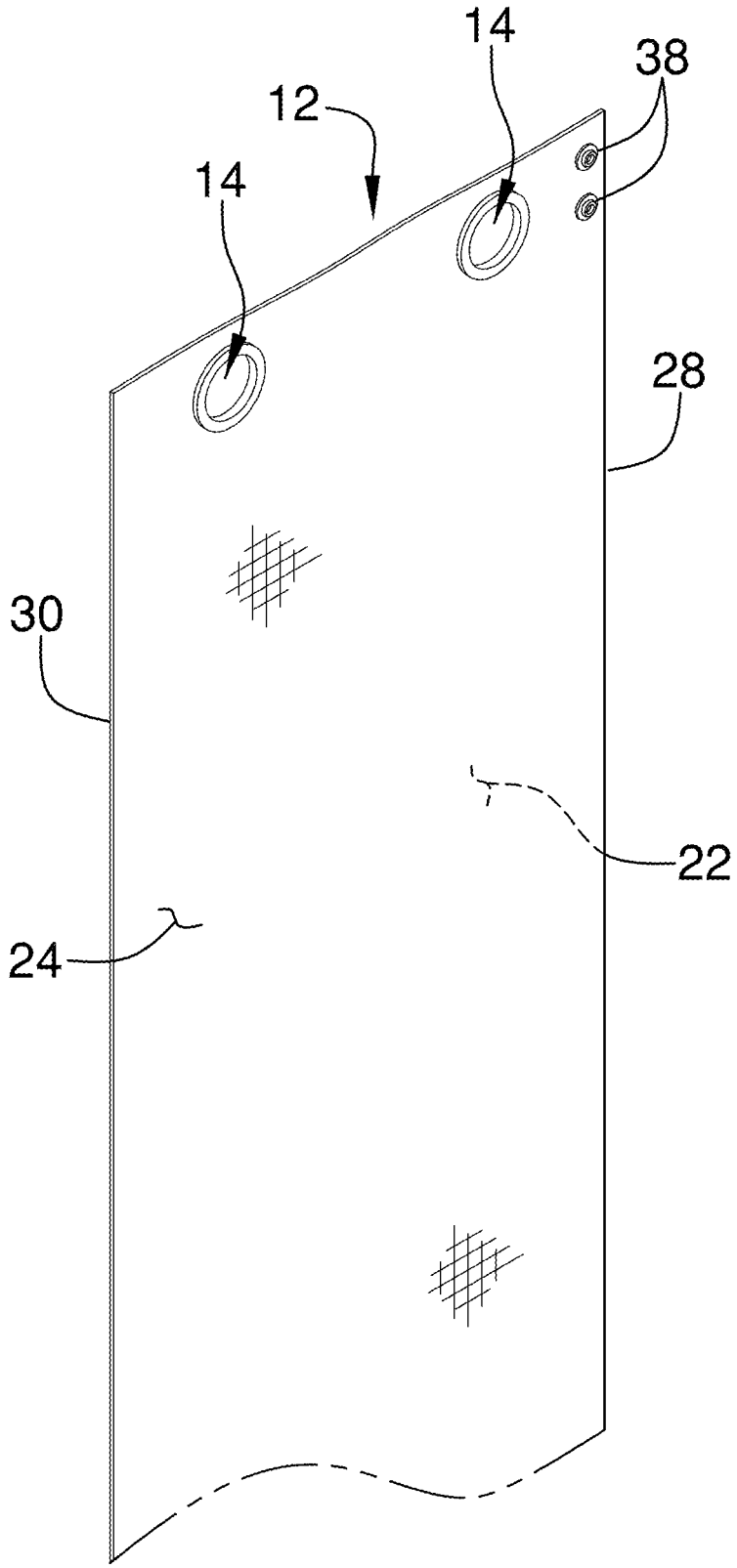
FIG. 2 is a back perspective view of an embodiment of the disclosure.
Figure 3:
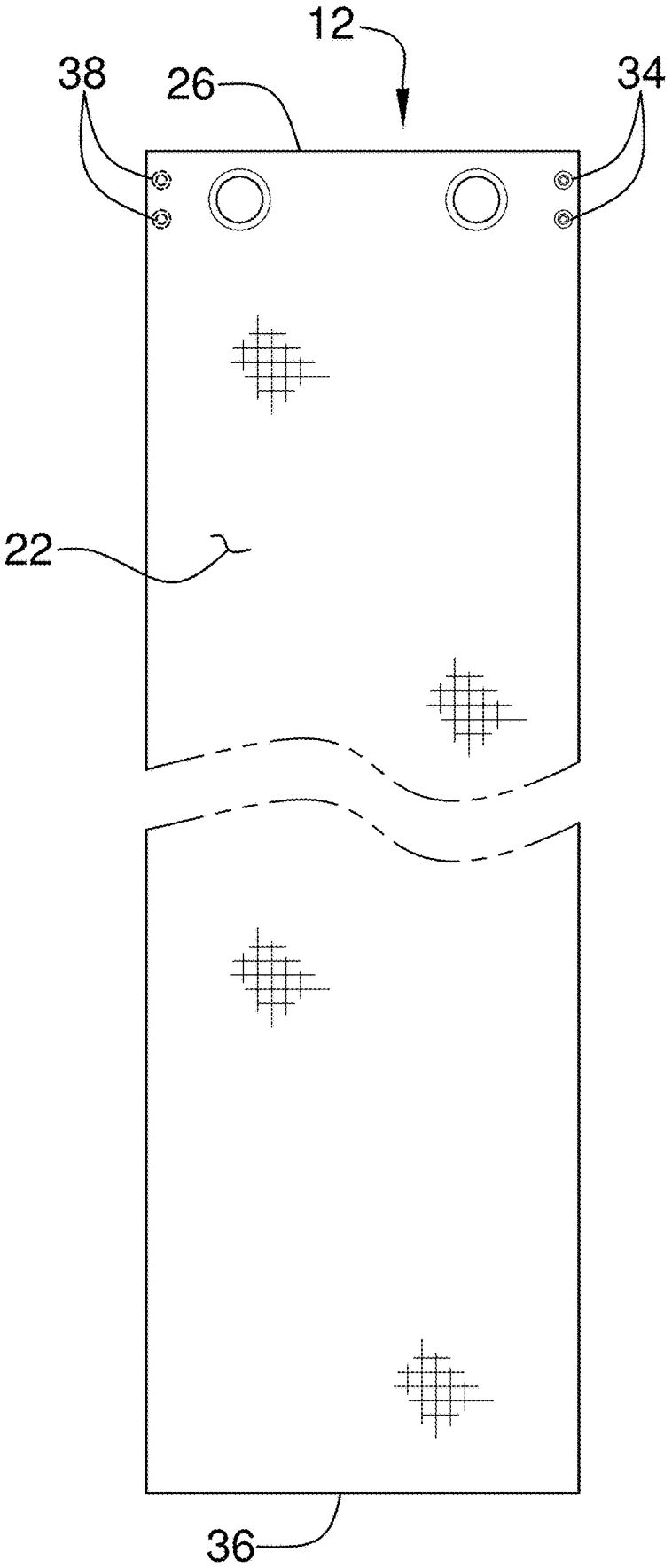
FIG. 3 is a front phantom view of an embodiment of the disclosure.
Figure 4:
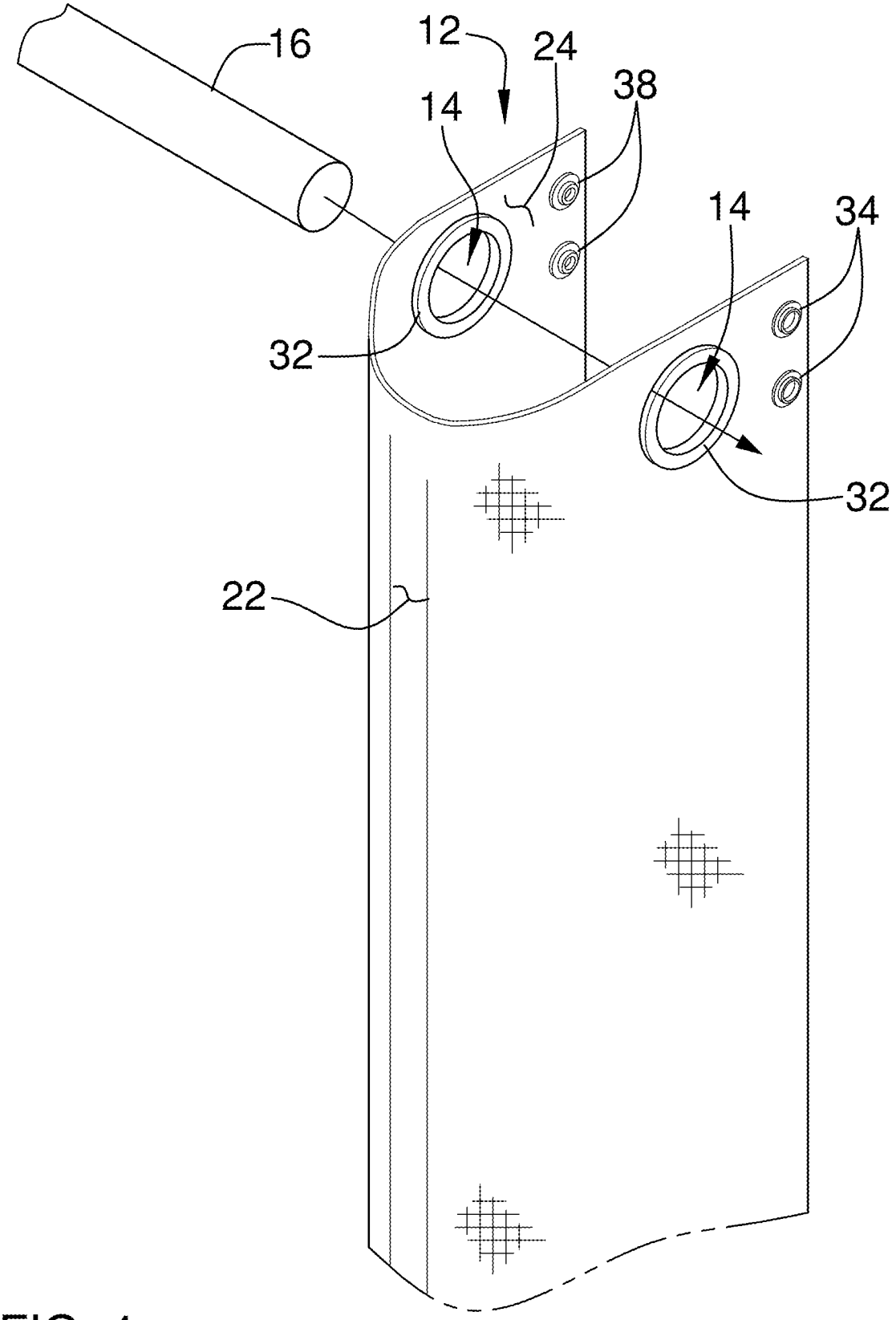
FIG. 4 is a perspective view of an embodiment of the disclosure showing a curtain rod being inserted through a pair of curtain rod holes.
Figure 5:
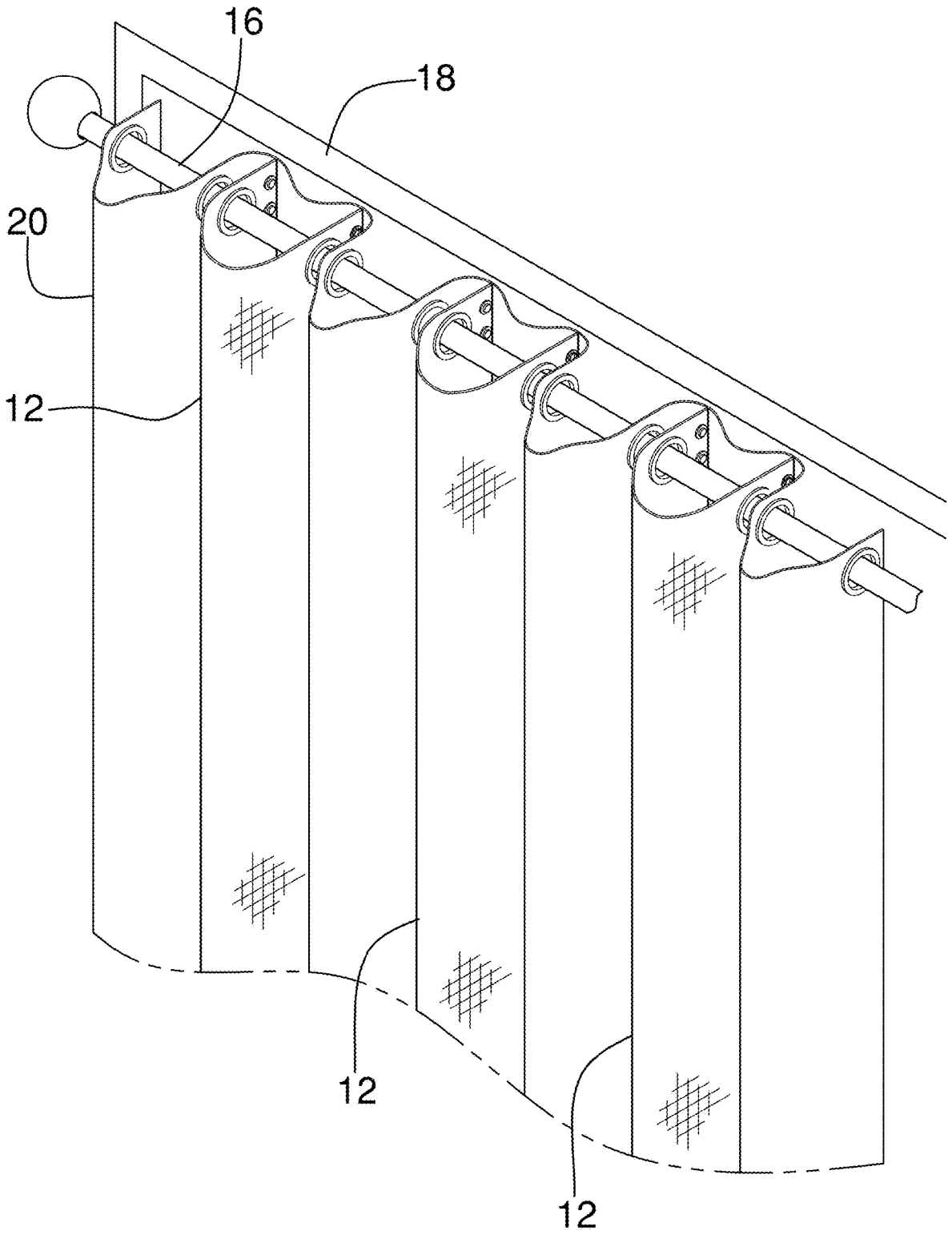
FIG. 5 is a perspective in-use view of an embodiment of the disclosure showing a plurality of drape panels being positioned on existing drapes of a window.
Figure 6:
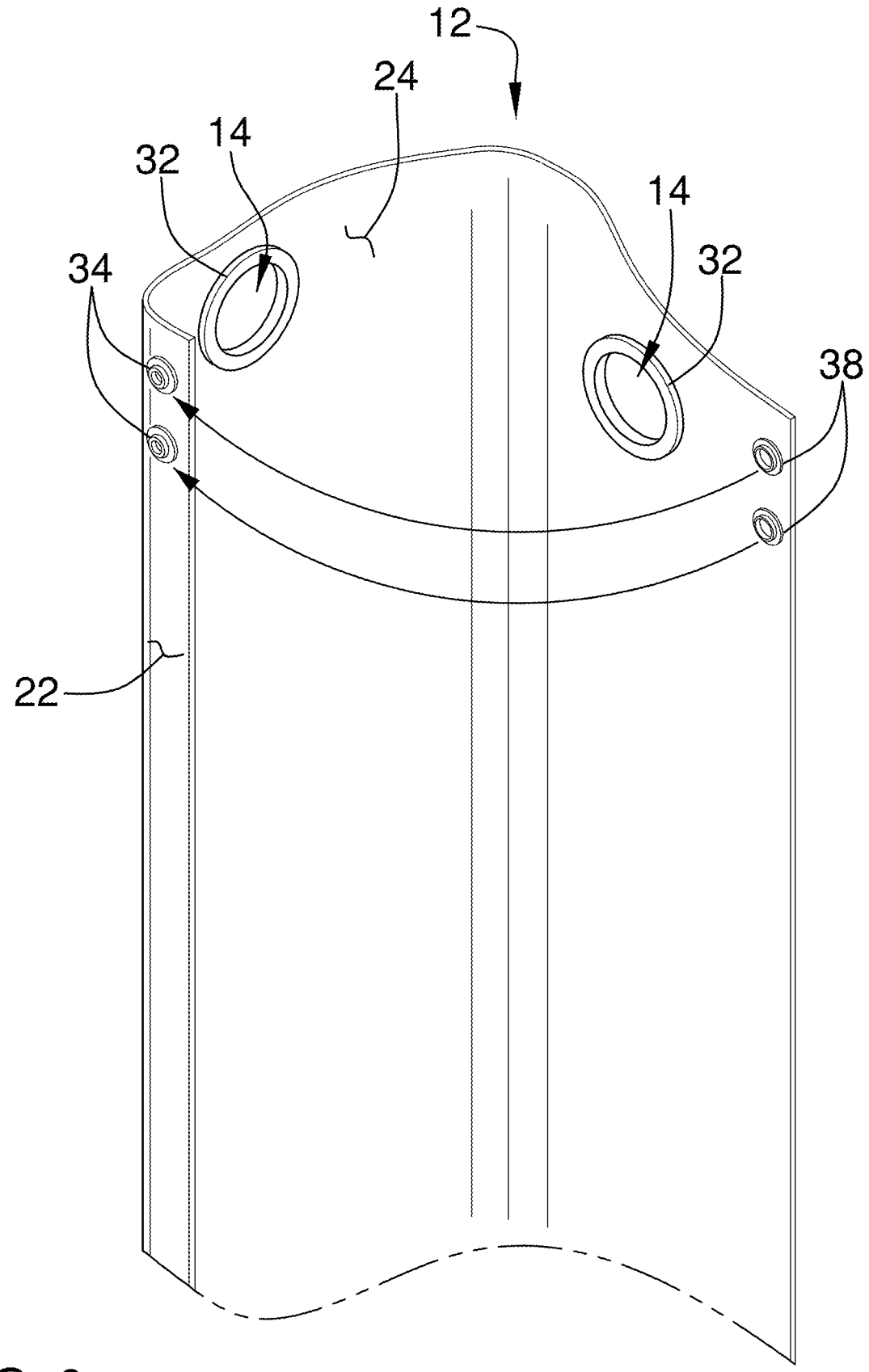
FIG. 6 is a perspective view of an embodiment of the disclosure showing a pair of first fasteners being mated to a pair of second fasteners.
Figure 7:
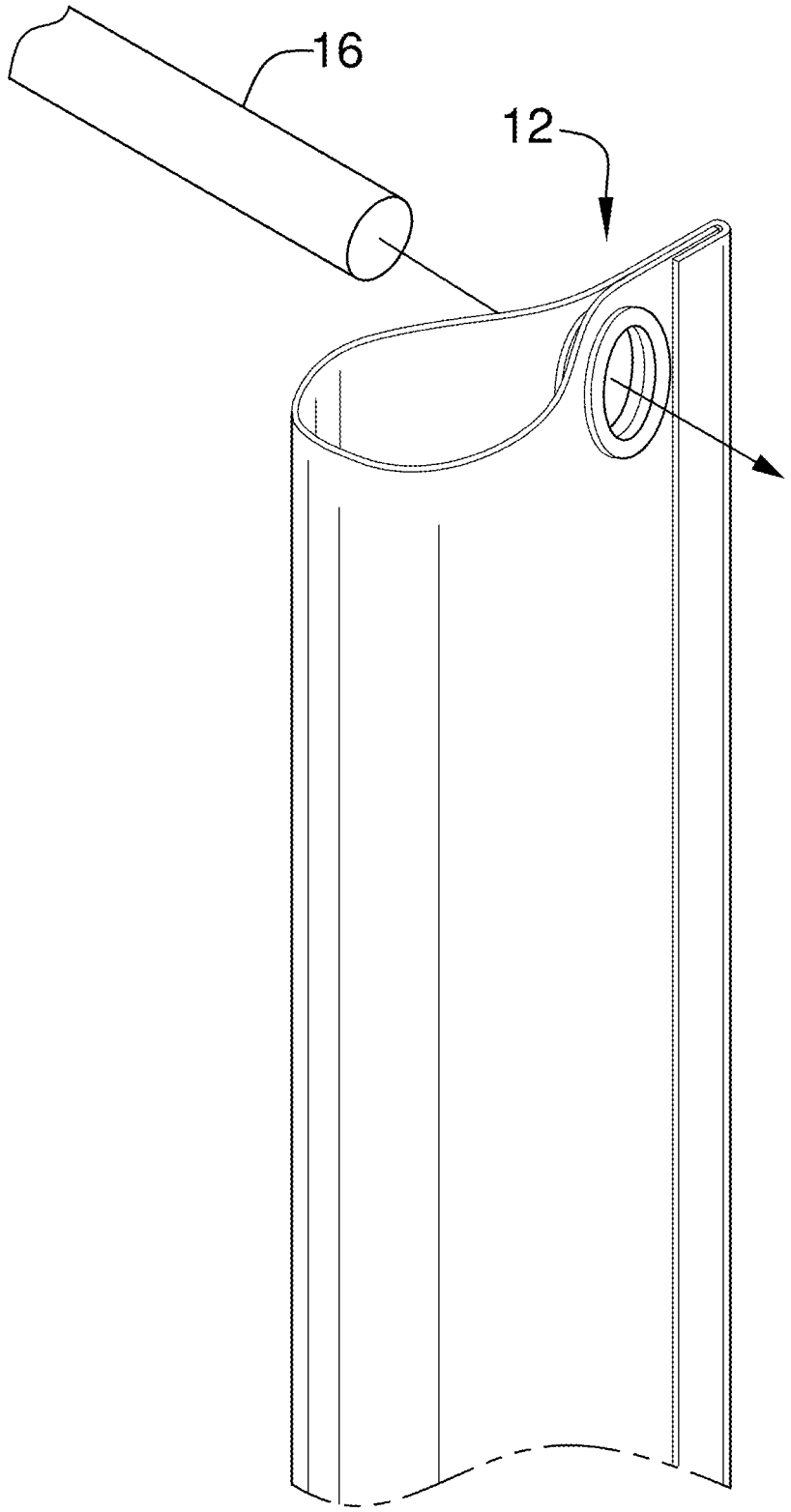
FIG. 7 is a perspective view of an embodiment of the disclosure showing a curtain rod being inserted through a pair of curtain rod holes when a drape panel has been formed into a tube.
Figure 8:
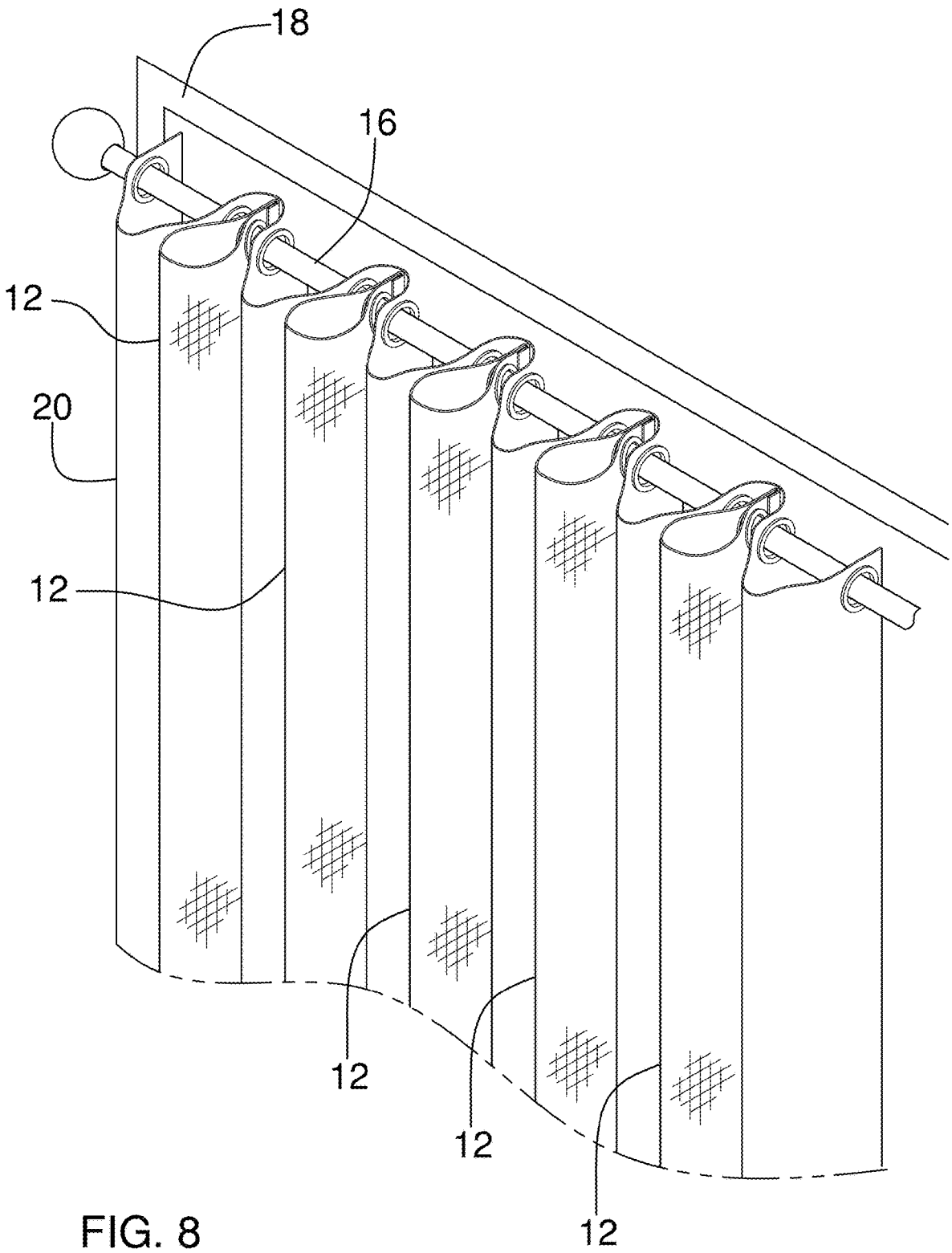
FIG. 8 is a perspective in-use view of an embodiment of the disclosure showing a plurality of drape panels being positioned on an existing drape of a window when the plurality of drape panels have been formed into a tube.

With reference now to the drawings, and in particular to FIGS. 1 through 8 thereof, a new window drape device embodying the principles and concepts of an embodiment of the disclosure and generally designated by the reference numeral 10 will be described.

As best illustrated in FIGS. 1 through 8, the window drape accessory device 10 generally comprises a drape panel 12 which has a pair of curtain rod holes 14 each extending through the drape panel 12 to insertably receive a curtain rod 16 thereby enabling the drape panel 12 to be suspended in front of a window 18. The window 18 may be a window in a house, an apartment, an office building or any other type of occupancy. The drape panel 12 has a width that may range between approximately 30.0 cm and 53.0 cm. Additionally, the drape panel 12 may have a length that matches the length of existing drapes 20 that are commonly employed as window 18 treatments in homes or apartments or offices. In this way the drape panel 12 can ornamentally accessorize existing drapes 20 on the window 18 without having the drape panel 12 covering the window 18. Furthermore, the drape panel 12 is manufactured in a variety of contrasting colors to enhance the ornamental appearance of the existing drapes 20 on the window 18. Furthermore, the drape panel 12 may have logos or indicia printed on the drape panel 12 that was chosen by a user. The drape panel 12 is comprised of a textile material, including but not being limited to cotton or nylon, thereby enabling the drape panel 12 to match the material appearance of the existing drapes 20 on the window 18.

Each of the curtain rod holes 14 extends through a front surface 22 and a back surface 24 of the drape panel 12 at a point which is spaced downwardly from a top edge 26 of the drape panel 12. Additionally, each of the pair of curtain rod holes 14 is spaced from a respective one of a first lateral edge 28 and a second lateral edge 30 of the drape panel 12. A pair of annular rings 32 is each integrated into the drape panel 12 and each of the pair of annular rings 32 is oriented to surround a respective one of the pair of curtain rod holes 14. Each of the pair of annular rings 32 is comprised of a resilient material, including but not being limited to plastic or metal, to inhibit the drape panel 12 from being damaged by the curtain rod 16 when the curtain rod 16 is extended through each of the pair of curtain rod holes 14.

A pair of first fasteners 34 is provided and each of the pair of first fasteners 34 is attached to the drape panel 12. Additionally, each of the pair of first fasteners 34 is positioned adjacent to a respective one of the pair of curtain rod holes 14. Each of the pair of first fasteners 34 is positioned on the front surface 22 of the drape panel 12 and each of the pair of first fasteners 34 is spaced apart from each other and is distributed along a line which extends between the top edge 26 and a bottom edge 36 of the drape panel 12. Furthermore, each of the pair of first fasteners 34 is positioned between the respective curtain rod hole 14 and the first lateral edge 28 of the drape panel 12. Each of the pair of first fasteners 34 may comprise a button snap or other type of multiple use, releasable mechanical fastener.

A pair of second fasteners 38 is provided and each of the pair of second fasteners 38 is attached to the drape panel 12. Each of the pair of second fasteners 38 is positioned adjacent to a respective one of the pair of curtain rod holes 14. Furthermore, each of the pair of second fasteners 38 is releasably matable to a respective one of the pair of first fasteners 34 thereby enabling the drape panel 12 to form a tube. In this way the drape panel 12 is enabled to enhance the ornamental appearance of the existing drapes 20 on the window 18. Each of the pair of second fasteners 38 is positioned on the back surface 24 of the drape panel 12 and each of the pair of second fasteners 38 is spaced apart from each other and is distributed along a line which extends between the top edge 26 and the bottom edge 36 of the drape panel 12. Additionally, each of the pair of second fasteners 38 is positioned between the respective curtain rod hole 14 and the second lateral edge 30 of the drape panel 12. Each of the pair of second fasteners 38 may comprise a button snap or other type of multiple use, mechanical fastener.

In use, one or more of the drape panels 12 is positioned on the curtain rod 16 in a desired arrangement to enhance the ornamental appearance of the existing drapes 20 on the window 18. Furthermore, the drape panels 12 can be chosen in a color which contrasts with the color of the existing drapes 20 on the window 18 to satisfy the design sensibilities of the user. Each of the first fasteners 34 can be mated to the second fasteners 38 to form the drape panel 12 into a tube thereby enabling additional ornamental enhancement of the existing drapes 20 on the window 18. Furthermore, the limited width of the drape panel 12 with respect to the width of the existing drapes 20 on the window 18 enables the existing drapes 20 to be opened to allow sunlight to pass through the window 18 without having the drape panel 12 blocking the sunlight.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A window drape accessory device for enhancing the ornamental appearance of window drapes, said device comprising:

a drape panel having a pair of curtain rod holes each extending through said drape panel wherein each of said pair of curtain rod holes is configured to insertably receive a curtain rod thereby enabling said drape panel to be suspended in front of a window, said drape panel having a width being no greater than 53.0 cm wherein said drape panel is configured to ornamentally accessorize existing drapes on the window without having said drape panel covering the window, said drape panel being manufactured in a variety of contrasting colors wherein said drape panel is configured to enhance the ornamental appearance of the existing drapes on the window;

a pair of first fasteners, each of said pair of first fasteners being attached to said drape panel, each of said pair of first fasteners being positioned adjacent to a respective one of said pair of curtain rod holes; and a pair of second fasteners, each of said pair of second fasteners being attached to said drape panel, each of said pair of second fasteners being positioned adjacent to a respective one of said pair of curtain rod holes, each of said pair of second fasteners being releasably matable to a respective one of said pair of first fasteners thereby enabling said drape panel to form a tube wherein said drape panel is configured to enhance the ornamental appearance of the existing drapes on the window;

wherein each of said curtain rod holes extends through a front surface and a back surface of said drape panel at a point being spaced downwardly from a top edge of said drape panel;

wherein each of said pair of curtain rod holes is spaced from a respective one of a first lateral edge and a second lateral edge of said drape panel;

wherein said device includes a pair of annular rings;

wherein each of said pair of annular rings is integrated into said drape panel;

wherein each of said pair of annular rings is oriented to surround a respective one of said pair of curtain rod holes;

wherein each of said pair of annular rings is comprised of a resilient material wherein each of said pair of annular rings is configured to inhibit said drape panel from being damaged by the curtain rod when the curtain rod is extended through each of said pair of curtain rod holes;

each of said pair of first fasteners being positioned on a front surface of said drape panel; and each of said pair of second fasteners is positioned on said back surface of said drape panel such that mating of said second fasteners to said first fasteners positions a portion of said back surface facing said front surface to form said tube.

2. The device according to claim 1, wherein each of said pair of first fasteners is spaced apart from each other and is distributed along a line which extends between said top edge and a bottom edge of said drape panel.

3. The device according to claim 2, wherein:

each of said pair of first fasteners is positioned between said respective curtain rod hole and said first lateral edge of said drape panel; and each of said pair of first fasteners is positioned closer to said first lateral edge than said respective curtain rod hole.

4. The device according to claim 1, wherein each of said pair of second fasteners is spaced apart from each other and is distributed along a line which extends between said top edge and a bottom edge of said drape panel.

5. The device according to claim 4, wherein:

each of said pair of second fasteners is positioned between said respective curtain rod hole and said second lateral edge of said drape panel; and each of said pair of second fasteners is positioned closer to said second lateral edge than said respective curtain rod hole.

6. A window drape accessory device for enhancing the ornamental appearance of window drapes, said device comprising:

a drape panel having a pair of curtain rod holes each extending through said drape panel wherein each of said pair of curtain rod holes is configured to insertably receive a curtain rod thereby enabling said drape panel to be suspended in front of a window, said drape panel having a width being no greater than 53.0 cm wherein said drape panel is configured to ornamentally accessorize existing drapes on the window without having said drape panel covering the window, said drape panel being manufactured in a variety of contrasting colors wherein said drape panel is configured to enhance the ornamental appearance of the existing drapes on the window, each of said curtain rod holes extending through a front surface and a back surface of said drape panel at a point being spaced downwardly from a top edge of said drape panel, each of said pair of curtain rod holes being spaced from a respective one of a first lateral edge and a second lateral edge of said drape panel;

a pair of annular rings, each of said pair of annular rings being integrated into said drape panel, each of said pair of annular rings being oriented to surround a respective one of said pair of curtain rod holes, each of said pair of annular rings being comprised of a resilient material wherein each of said pair of annular rings is configured to inhibit said drape panel from being damaged by the curtain rod when the curtain rod is extended through each of said pair of curtain rod holes;

a pair of first fasteners, each of said pair of first fasteners being attached to said drape panel, each of said pair of first fasteners being positioned adjacent to a respective one of said pair of curtain rod holes, each of said pair of first fasteners being positioned on said front surface of said drape panel, each of said pair of first fasteners being spaced apart from each other and being distributed along a line which extends between said top edge and a bottom edge of said drape panel, each of said pair of first fasteners being positioned between said respective curtain rod hole and said first lateral edge of said drape panel; and a pair of second fasteners, each of said pair of second fasteners being attached to said drape panel, each of said pair of second fasteners being positioned adjacent to a respective one of said pair of curtain rod holes, each of said pair of second fasteners being releasably matable to a respective one of said pair of first fasteners thereby enabling said drape panel to form a tube wherein said drape panel is configured to enhance the ornamental appearance of the existing drapes on the window, each of said pair of second fasteners being positioned on said back surface of said drape panel such that mating of said second fasteners to said first fasteners positions a portion of said back surface facing said front surface to form said tube, each of said pair of second fasteners being spaced apart from each other and being distributed along a line which extends between said top edge and said bottom edge of said drape panel, each of said pair of second fasteners being positioned between said respective curtain rod hole and said second lateral edge of said drape panel.

* * * * *